US006385131B1

(12) United States Patent
Woodsum et al.

(10) Patent No.: US 6,385,131 B1
(45) **Date of Patent: *May 7, 2002**

(54) THERMOACOUSTIC COMMUNICATIONS SYSTEM

(75) Inventors: Harvey C. Woodsum, Nashua, NH (US); Richard A. Jensen, Andover; Charles A. Carey, Burlington, both of MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 06/392,186

(22) Filed: Jun. 28, 1982

(51) Int. Cl.[7] ..... H04R 1/44
(52) U.S. Cl. ..... 367/142
(58) Field of Search ..... 340/850; 181/142, 181/0.5; 356/5; 367/131, 132, 137, 138, 149, 141, 1

(56) References Cited

U.S. PATENT DOCUMENTS 3,230,506 A * 1/1966 Hellund ..... 367/147
3,243,592 A * 3/1966 Tomiyasu et al. ..... 340/850
3,392,368 A * 7/1968 Brewer et al. ..... 181/113
3,530,398 A * 9/1970 Itzkan et al. ..... 356/5
3,913,060 A * 10/1975 Westervelt et al. ..... 367/107
4,277,167 A * 7/1981 Eppel ..... 356/5

OTHER PUBLICATIONS

Gournay, *J. Acous. Soc. Amer.*, vol. 40, No. 6, 1966 pp. 1322–1330.*

* cited by examiner

*Primary Examiner*—Daniel T. Pihulic
(74) *Attorney, Agent, or Firm*—Vernon Maine; Scott Asmus

(57) ABSTRACT

This invention is a thermoacoustic system for communicating between an airborne or spaceborne vehicle and a sound detector that is located aboard an object beneath the surface of the water. The foregoing system comprises a laser or particle accelerator that is located aboard an airborne or spaceborne vehicle. The laser produces a light beam whose amplitude is subsequently modulated or whose pulses are varied in time. A particle accelerator would produce a pulsed particle beam that varies in time. These modulated or varied pulses are focused or deflected to a small layer of water at the air/water interface so that the beam will be absorbed by the water causing the water to produce an acoustic signal that will propagate to the sound detector.

21 Claims, 2 Drawing Sheets

THERMOACOUSTIC COMMUNICATIONS SYSTEM

CROSS REFERENCE TO RELATED APPLICATIONS

Reference is made to the following concurrently filed and related patent applications which are assigned to the present assignee:

1. D-3735 entitled "Thermoacoustic Torpedo Jammer" Ser. No. 06/392,184, filed Jun. 28, 1982; now abandoned;
2. D-3736 entitled "Thermoacoustic Bi Static Sonar System" Ser. No. 06/392,183, filed Jun. 28, 1982; now abandoned;
3. D-3738 entitled "Steerable Thermoacoustic Array" Ser. No. 06/392,182, filed Jun. 28, 1982.

FIELD OF THE INVENTION

This invention relates to communications systems and more particularly to communications between an airborne or spaceborne vehicle and an underwater receiver.

BACKGROUND OF THE INVENTION

Submarines complete large portions of their missions while being submerged. Occasionally, while the submarine is submerged an airborne vehicle may want to communicate with the submarine. The prior art utilized two methods for the transmission of information from an aircraft or satellite to points under water. The first method used electromagnetic energy transmitted from the aircraft or satellite to carry the signal. Electromagnetic (EM) energy does not propagate well in water, except in certain bands of the EM spectrum. Usable bands of the spectrum are the Extremely Low Frequency (ELF), Very Low Frequency (VLF) and the Visible Light bands (in the blue-green regime). The disadvantages of the foregoing method are that both VLF, ELF and blue-green signals are difficult to generate and transmit without heavy and massive equipment. The VLF and ELF communication schemes employ a very long and cumbersome antenna which must be deployed from the aircraft or satellite, and a similar antenna for receiving the electromagnetic signals must be deployed under water. An aircraft or submarine's agility is degraded by the deployment of such an antenna. The blue-green light communication scheme is very inefficient. Therefore, a very powerful laser must be used to transmit coherent blue-green light. The underwater receiver is a complex and highly sensitive light detector which employs very narrowband atomic transitions. The signal to noise ratio of the receiver at the receiving point is very low, since most of the light is scattered and attenuated as it propagates down from the water surface. Both low frequency electromagnetic techniques and blue-green communication require the receiver to be within at least 1,000 ft. of the water surface, which is not always practical. The second method used by the prior art for the transmission of information from an aircraft or satellite to an underwater receiver utilized the transmission of an RF signal to a surface ship or buoy. The buoy or surface ship then retransmitted the message underwater using acoustic energy. Acoustic energy in the sonic frequency regime can propagate miles underwater, thus making this scheme advantageous. However, some disadvantages of the foregoing method are that if the receiver is moving (e.g., if communication is to a moving submarine) the receiver may still move out of range of the acoustic transmitter, requiring the surface ship to move or deploy new expendable buoys. Furthermore, at distances of several miles from the acoustic transmitter, the transmitted information may arrive by several propagation paths, which are caused by refraction of acoustic energy by thermal gradients and reflections of the acoustic signal from the water surface and the ocean's bottom. This "multipath" phenomenon is similar to reverberation in a room of bad acoustic design, and can result in reduced intelligibility of the communication. It was also possible for an unfriendly power to intercept or jam the prior art methods which relied on ELF, VLF or RF transmission.

SUMMARY OF THE INVENTION

This invention overcomes the disadvantages of the prior art by utilizing the direct conversion of EM or particle kinetic energy into acoustic energy. The foregoing is accomplished by using either a pulsed infrared wavelength laser or particle beam which is fired into the water from an aircraft or satellite. The physical mechanisms producing sound are of two kinds: (1) thermal expansion of the water from heat generated by medium attenuation of a pulse of laser light or impinging particles, or (2) explosive vaporization of a small volume of water when the heat deposited by the laser or particle beam is large enough to raise the local water temperature above boiling threshold. Infrared laser light is usually used because of its high attenuation coefficient in water, which causes high thermal densities. The level of sound produced by infrared lasers is sufficient for communications at expected ranges of communication buoys. Infrared lasers may be controlled (modulated) to the extent required for an underwater communications system. Typical data rates are ~1–10 bits per second.

Modulation schemes which may be employed are on-off keying (OOK), pulse duration modulation (PDM), pulse amplitude modulation (PAM), and frequency shift keying (FSK). The foregoing modulation schemes may be used for lasers and particle beams.

When the density of the heat energy deposited by laser beam absorption is less than that required to vaporize a local volume of water (~2500 joules/cm$^3$) the acoustic pressure at radial distance R and polar angle θ from the beam impact point at the water surface is given by the following expression:

$$P(R, t, \theta) = \frac{k}{2\pi}\int_{-\infty}^{+\infty} d\omega M(\omega)\omega^2 \exp[-j(\omega t - R/c_o)] \cdot \sin\theta$$

where $k=\beta I_o/(4\pi R c_o C_p)$ $C_o$=speed of sound $C_p$=specific heat of water $I_o$=laser power output t=time β=thermal expansion coefficient of water Here $M(\omega)$ is the Fourier transform of the modulation, and $I_o$ the laser power output prior to modulation. The above expression assumes that the useful portion of the acoustic signal is transmitted at a frequency with wavelength smaller than either the beam spot size or absorption depth.

If the modulation is a gaussian pulse $$M(t) = \frac{M_o}{\sqrt{2\pi\sigma_t}} \exp[-t^2/\sigma_t^2]$$

where $\sigma_t \cong$(one-half of the laser pulse width). The Fourier transform of $P(R,\theta)$ is proportional to the function $F(\omega)=\omega^2 \exp[-\omega^2\sigma t^2]$.

The frequency ($\omega_\rho$) when the spectral energy is the acoustic pulse peak is $$\omega_p = \frac{1}{\sqrt{3}}\sigma_t - 1$$

as can be found by setting the derivative of $F(\omega)$ equal to zero.

Thus, the duration of the laser pulse ($2\sigma_t$) controls the spectral $W_p$. The bandwidth of the signal can be controlled by firing the laser a number of times at a repetition interval less than or equal to the duration of an acoustic pulse produced by a single laser pulse, or by simply lengthening the pulse duration for a single pulse. The pulse amplitude may be controlled and varied by changing the laser power output.

The extremely short 1–10$\mu$ absorption length ($\delta$) for certain infrared light frequencies in water makes an explosive vaporization mode of thermoacoustic generation attractive. Incident light with a fluence of >3 J/cm$^2$($E_r$) at 10$\mu$ wavelength, for instance, will instantaneously boil the 10 micron layer in which most of the light is absorbed. This rapid vaporization produces an explosive stress or shock wave (with Fourier transform $S(\omega)$) which eventually propagates through the water as a soundwave (with Fourier transform proportional to $\omega S(\omega)$). The internal energy (E) contained in the gas that was vaporized is approximately given by the ideal gas state equation:

$E=3/2\ P\ V$ where E is the difference between the laser energy and the threshold energy required to boil the thin layer of water. The initial pressure in the gas bubble would approximately be given by $$P_o = \frac{2}{3}\frac{(E_o - E_T)}{V}$$

where:

$E_o$=laser pulse energy $E_T$=Threshold for vaporization

V=Volume of fluid in which absorption of light occurs $V=A\delta$=(spot area)×(laser light absorption depth)

Reasonable values for the spot area (A) and absorption lengths are:

A=spot area=1 CM$^2$=$10^{-4}$m$^2$ $\delta$=absorption length of fluid=$10^{-5}$m at $CO_2$ laser wavelengths The determination of allowable communication path length requires a knowledge of the spectral level and distribution of the acoustic energy represented by the source strength given above. The duration of the time domain pulse resulting from explosive vaporization of the water surface layer must be estimated to obtain its spectral distribution. Assume the laser pulse is sufficiently short (<$10^{-6}$ sec.) so that all the laser energy is absorbed before the explosive vaporization has appreciably progressed. The time required to expand $10^{-9}$m$^3$ volume of water to 1 ATM gaseous phase is roughly one-half the width of the acoustic pulse produced. The expanded volume of the water is $10^{-6}$m$^3$ based on the roughly $10^3$ difference in density between liquid water and water vapor at 1 ATM. The vapor bubble expands at roughly Mach two in air (2200 m/sec.) forming a spherical segment of volume ~$10^{-6}$m$^3$.

The time for the expansion to take place is

T=4.5$\mu$ sec.

at Mach two. The center frequency of the wideband pulse thus produced is $f_o$=(1/(9 $\mu$sec))≅110 KHz The spectrum of the thermoacoustic pulse is a roughly 100% bandwidth pulse centered on $f_o$ thus with single pulse on-off coding the signal bandwidth is (BW)=110 KHz.

Taking, for example, a 10 joule laser pulse, the peak pressure at the surface is $$P_s = \frac{2}{3}\frac{(E_o - E_r)}{A\delta}$$

$$P_s = \frac{2}{3}\frac{(10-3)}{(10^{-4})(10^{-5})}$$

or 293 dB relative to 1 $\mu$Pa (rel$\mu$Pa)

Assuming spherical spreading from an initial radius ($R_o$) of the source, the source strength at a range R is $$P(R) = P_o\frac{(R_o)}{R}f(\hat{\theta})$$

where $\theta$ is the horizontal propagation angle, and $f(\theta)$ is the source directivity ($\approx\sin\theta$). The initial radius can be taken as $V^{1/3}$ where $V=10^{-6}$m$^3$ so that $R_o=10^{-2}$m. The resulting source strength at 1 meter below the beam impact point ($\sin\theta=1$) is then SL=20 log P(1)=293−20 log $10^4$ or SL=213 dB re (1$\mu$Pa)

The standard sonar equation can be used to estimate the excess signal at a distance r meters from the source. In the above example, the spectrum of the acoustic signal is approximately linear with frequency for $\omega<\omega\rho$. Thus, the spectra level (dB//Hz) at 10 KHz (our assumed transmit frequency) is dB below that at 110 KHz. The spectrum level for $$\theta = \frac{\pi}{2}\ \text{rad.}$$

a 110 KHz is about 213 dB−10 log (1.1×$10^5$ Hz)≅163 dB//Hz. Therefore, the acoustic spectrum level at 10 KHz≈143 dB//Hz The sonar equation is inverted to give Figure of Merit (maxim propagation loss) for good communication reliability. This yields (Figure of Merit) FOM=143−45−12 =86 dB=source spectrum level—noise spectrum level—threshold.

The signal-to-noise ratio required to reliably communicate is assumed to be 12 dB. The range of the signal pulse on-off keyed communication system described above corresponding to an 86 dB FOM is 6 Kyd. Receiving the signal with a directional receiver will increase this range considerably. A practical system calls for bit rates of the order of 5 bits a second or 50 watts of laser power with 10 joule pulses.

An alternate use of the laser energy would be to fire the laser every $\tau$ sec to obtain a more narrowband acoustic wave train centered on $\tau^{-1}$. For instance, a ten cycle burst at the same laser power per pulse (10 J) cited above would require 100 joules. The bandwidth would be 11,000 Hz. Thus, if coherent detection could be used, an extra 10 dB of transmission loss could be tolerated.

A particle beam generates acoustic energy by impacting a small region of the surface of the water at the air/water interface. Energy from the aforementioned beam is absorbed by the water which causes the water to be heated. The heating of the water causes thermal expansion which generates pressure or stresses within the water that propagate through the water as a sound wave. The pressure P produced by the particle beam is given by expressions provided above for the thermoelastic energy case with the power flow in the particle beam replacing the laser power in the formulas.

Thus, by turning the particle beam on and off, a code similar to the one hereinbefore described may be produced because different amounts of energy will be absorbed by the water at different intervals of time causing acoustic signals to be produced which may be received by a sound detector.

It is an object of this invention to provide a new and improved communications system between an airborne or spaceborne vehicle and an object that is underwater.

Other objects and advantages of this invention will become more apparent as the following description proceeds, which description should be considered together with the accompanying drawings.

DESCRIPTION OF A PREFERRED EMBODIMENT

Figure 1:
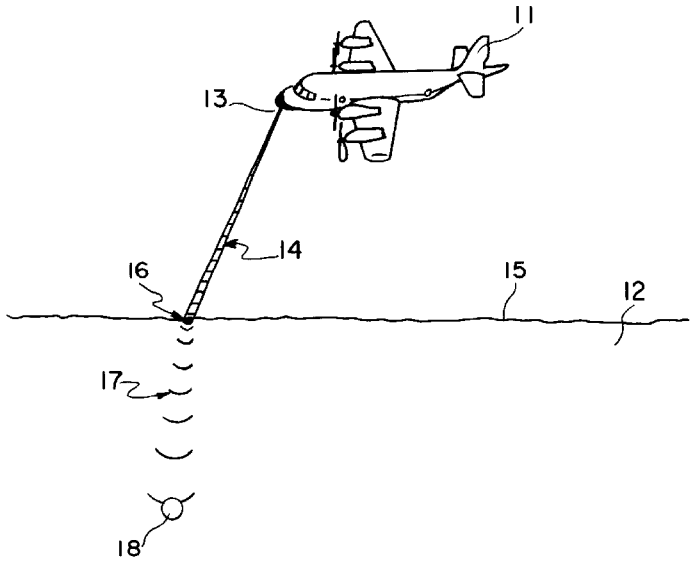
FIG. 1 is a perspective showing the apparatus of this invention being flown aboard an airborne platform directing a beam on the surface of the water to produce acoustic signals.

Referring now to the drawings in detail, and more particularly to FIG. 1, the reference character 11 represents an airborne or spaceborne platform i.e., aeroplane, helicopter, satellite, that is flying above the water 12. The apparatus of this invention 13 may be contained within the nose of aircraft 11. Apparatus 13 produces a pulsed electromagnetic or ion beam 14 hereinafter described which is directed at air/water interface 15. Beam 14 will cause approximately a 10 micron layer 16 of interface 15 to be heated causing the generation of acoustic signals 17. Signal 17 may be detected by a sound detection receiver 18 that is aboard an underwater vehicle and/or device, i.e., submarine, torpedo, mine, drilling rig, etc. Acoustic signals 17 may also be generated by having beam 14 introduce enough heat into layer 16 so that the water contained within layer 16 will boil and produce a series of disturbances which are seen as signals 17.

Figure 2:
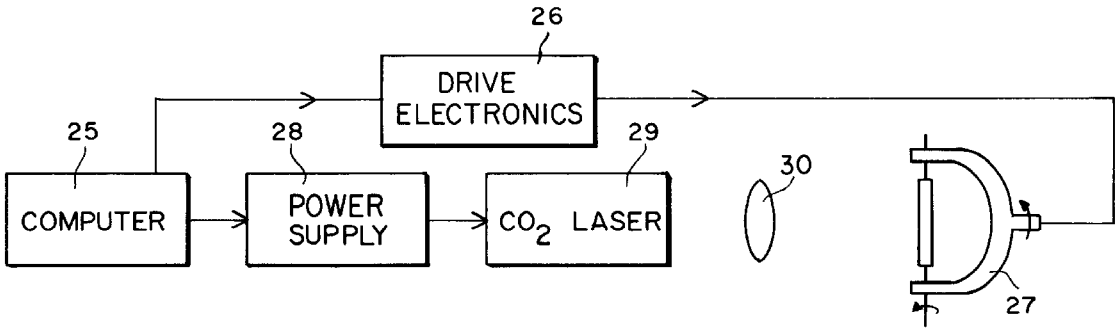
FIG. 2 is a block diagram showing the apparatus of this invention time multiplexing beams that produce acoustic signals.

FIG. 2 shows the apparatus of this invention being used for the generation of a time multiplexed code. Digital computer 25 is coupled to the input of high voltage power supply 28 and drive electronics 26. The output of drive electronics 26 is coupled to the input of steerable mirror 27 that is gimbaled with two degrees of freedom. The output of power supply 28 is coupled to the input of $CO_2$ laser 29. A $CO_2$ laser is used for the generation of thermoacoustic signals because of its high efficiency (10–20%); high power and short absorption length (10$\mu$ at 10.6 wavelength) in water; good propagation through bad weather; small reflection laser at the air/water interface and its inability to harm the human eye. Laser 29 is controlled by power supply 28 and computer 25. Other types of lasers may be used, namely: Infrared, Molecular, Carbon Monixide (CO), Deuterium Bromide (DBr). Computer 25 will turn power supply 28 on and off which, in turn, causes laser 29 to be turned on and off. Thus, every time computer 25 wants laser 25 to have an output, power supply 28 would be turned on to pump laser 29 and, conversely, when no output was wanted, power supply 28 would be turned off. Hence, laser 28 is turned on and off in such a manner so that the output of laser 29 will be a series of pulses of varying duration. The aforementioned pulses may be used to generate a binary coded message, i.e., a long pulse may represent a 1 and a short pulse may represent a 0. The pulses are transmitted to steerable mirror 27. Mirror 27 is controlled by electronics 26 and computer 25 so that the pulses may be directed to the point on the ocean surface 46 where an acoustic source is designed to a spot at the point 30. Lens 30 focuses the aforementioned laser pulse on the surface of the water where the heat of the laser pulses will cause the generation of an acoustic signal by causing a small layer of water at the water/air interface to expand or boil. This acoustic signal may be detected by an underwater receiver.

Figure 3:
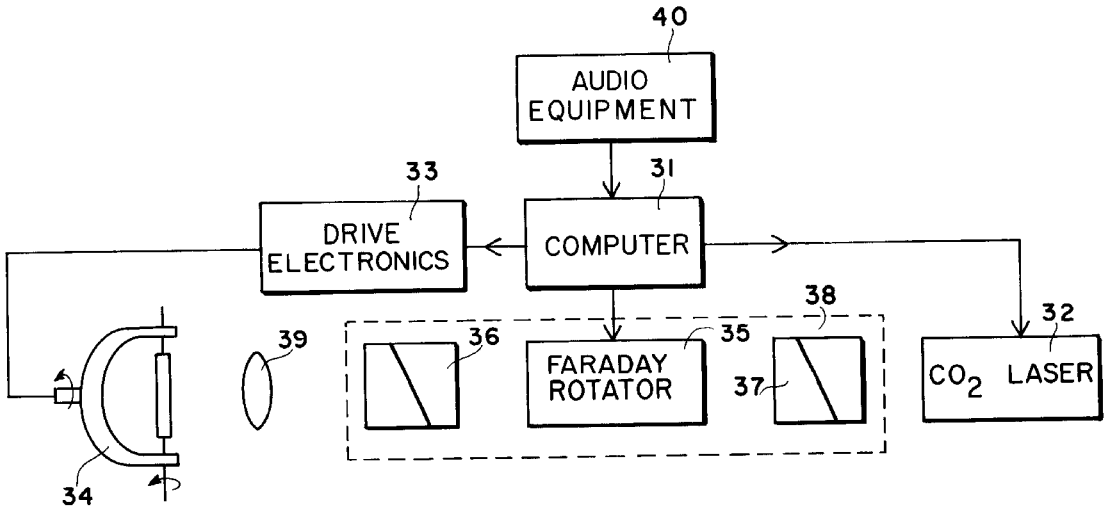
FIG. 3 is a block diagram showing the apparatus of this invention modulating the amplitude of beams to produce acoustic signals.

FIG. 3 depicts the apparatus of this invention being used to produce acoustic signals by modulating the amplitude of a laser beam. Digital computer 31 is coupled to the input of $CO_2$ laser 32, faraday rotator 35 and drive electronics 33. The output of drive electronics 33 is coupled to the input of steerable mirror 34. Modulator 38 comprises: faraday rotator 35; a polarizer 36 positioned to the left of rotator 35; and a polarizer 37 positioned to the right of rotator 35. When computer 31 transmits a signal to laser 32 and no signal is at the input to rotator 35, laser 32 will output a light beam that will pass through polarizer 37, rotator 35 and polarizer 36. The aforementioned light beam will be transmitted to steerable mirror 34 that is gimbaled with two degrees of freedom. Mirror 34 is controlled by electronics 33 and computer 31 so that the light beam produced by laser 32 may be directed to the desired spot on the ocean. Lens 39 focuses the abovementioned beam to a spot at the point on the surface of the water where the heat of the laser beam will cause the generation of an acoustic signal by causing a small layer of water at the water/air interface to expand or boil. When computer 31 transmits a signal to rotator 35, rotator 35 will rotate the plane of polarization of its input light beam 90 so that no light will be output by rotator 35 and polarizer 36. Thus, by controlling the electrical signals transmitted to rotator 35, laser 32, and electronics 33 by computer 31, the beam produced by laser 32 may be modulated in amplitude. This modulated signal may be modulated to produce a coded signal or an audio modulation on the laser beam when someone speaks into audio equipment 40 and equipment 40 transmits a signal to computer 31. When equipment 40 transmits signals to computer 31, computer 31 will transmit rhythmic output signals to rotator 35 that match the pattern of human speech.

Figure 4:
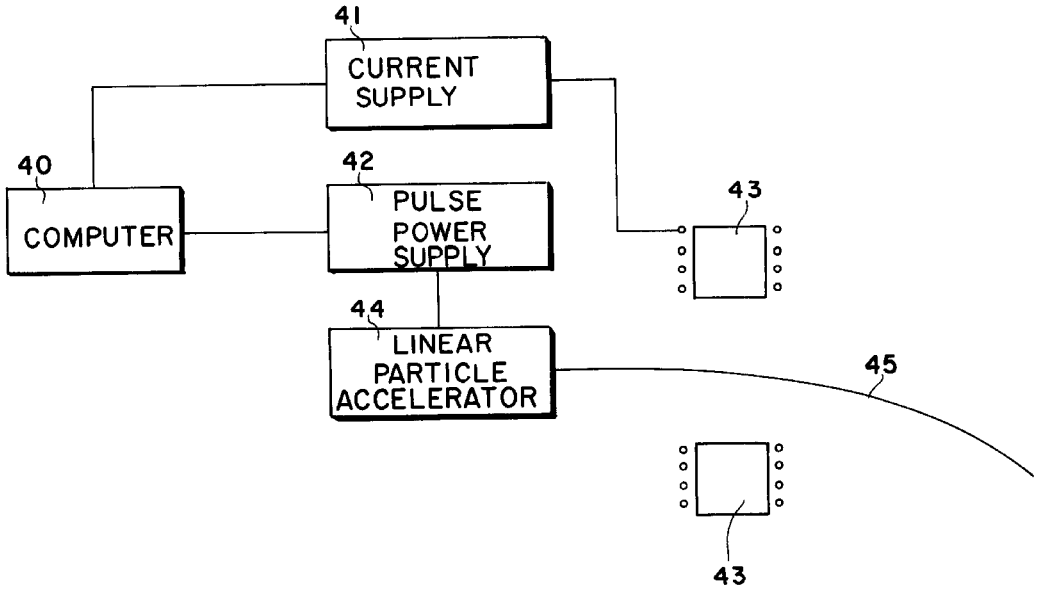
FIG. 4 is a block diagram showing an alternate embodiment of this invention that utilizes a particle accelerator for the generation of acoustic signals.

FIG. 4 shows an alternate embodiment of this invention that is used for the generation of a time multiplexed code. Digital computer 40 is coupled to the input of current supply 41 and pulse power supply 42. The output of current supply 41 is coupled to the input of steering coil 43 and the output of power supply 42 is coupled to the input of linear particle accelerator 44. Computer 40 turns power supply 42 on and off in such a manner so that the output of power supply 42 will control the output of accelerator 42. The output of accelerator 42 will be a series of pulses of charged particles 45 that vary in time and duration. Beam 45 will contain coded information which was hereinbefore described. Beam 45 will pass through steering coil 43 and steering coil 43 will deflect beam 45 to the air/water interface. The energy contained in the particles of beam 45 will heat the water and cause the generation of acoustic signals which may be received and decoded by a detector aboard an object beneath the surface of the ocean. Steering coil 43 deflects beam 45 by producing a magnetic field. The wires that comprise coil 43 run into the plane of the paper and the amount of deflection of the particles that comprise beam 45 is determined by the magnitude of the magnetic field. The greater the magnitude of the magnetic field, the greater the deflection of the particles within beam 45 and the greater the current that is supplied to coil 43. Thus, computer 40 can determine the path of beam 45 by controlling the amount of current that is supplied to coil 43.

The above specification describes a new and improved communications system. It is realized that the above description may indicate to those skilled in the art additional ways in which the principles of this invention may be used without departing from its spirit. It is, therefore, intended that this invention be limited only by the scope of the appended claims.

What is claimed is:

1. A thermoacoustic system for communicating between an object that is above the surface of the water and a sound detector that is beneath the surface of the water, said system comprising: a laser located above the water's surface that produces a light beam which impinges on a small layer of water at the water/air interface so that said light beam is absorbed by the water substantially immediately adjacent the water/air interface causing the water to expand and produce an acoustic wave of sufficient magnitude to propagate to the sound detector.

2. The system claimed in claim 1 wherein said laser is a $CO_2$ laser.

3. The system claimed in claims 1 or 2 wherein said laser is a DBr laser.

4. The system claimed in claims 1 or 2 wherein said laser is a CO laser.

5. A thermoacoustic system for communicating between an object that is above the surface of the water and a sound detector that is beneath the surface of the water, said system comprising: an amplitude-modulated laser located above the water's surface that produces an amplitude-modulated light beam which impinges on a small layer of water at the water/air interface so that said light beam is absorbed by the water substantially immediately adjacent the water/air interface causing the water to boil and produce an acoustic wave having sufficient magnitude to propagate to the sound detector.

6. A method for communicating between an object located above the surface of the water and an object located beneath the surface of the water including the steps of:

a. modulating the amplitude of a $CO_2$ laser beam that is located in the object above the water's surface in order to produce a signal that contains information;

b. directing said laser beam at a layer of water at the air/water interace; and c. heating said layer of water substantially immediately adjacent the air/water interface so that said layer of water will convert the light signal produced by said laser into an acoustic signal having sufficient magnitude to be detected by a sound detector located in the object beneath the water's surface.

7. A thermoacoustic communications system for transmitting information from a first object located above an air/water interface to a second object located below the air/water interface, said system comprising:

a. a particle accelerator located in the first object;

b. means for changing the output of said accelerator, said means being coupled to said accelerator so that the output of said accelerator will contain information; and c. means for deflecting the output of said accelerator coupled to said changing means, to direct the output of said accelerator to a small layer of water located at the air/water interface so that said layer of water will absorb heat substantially immediately adjacent the air/water interface and transform the information contained in the output of said laser to acoustic signals having sufficient magnitude to be detected by sound detectors located in the second object.

8. The system claimed in claim 7 wherein said changing means comprises:

a. a pulse power supply whose output is coupled to the input of said accelerator so that when said power supply is turned on said accelerator will produce a pulse of charged particles and when said power supply is turned off said accelerator will not have an output pulse; and b. a digital computer coupled to said deflecting means and said power supply, said computer will turn said power supply on and off in such a manner to produce accelerator output pulses that will vary in time and represent a coded message.

9. The system claimed in claim 8 wherein said deflecting means comprises:

a. a steering coil which produces a magnetic field positioned in front of the output of said accelerator, and b. a current power supply whose input is coupled to the output of said computer and whose output is coupled to the input of said coil so that the amount of current supplied to said coil will determine the magnitude of said magnetic field and the amount of deflection of said beam.

10. A thermoacoustic communications system for transmitting information from a first object located above an air/water interface to a second object located below the air/water interface, said system comprising:

a. a laser located in the first object;

b. means for changing the output of said laser, said means being coupled to said laser so that the output of said laser will contain information; and c. means for directing the output of said laser coupled to said changing means so that said laser output impinges on a small layer of water located at the air/water interface and said layer of water will absorb heat substantially immediately adjacent the air/water interface and transform the information contained in the output of said laser to acoustic signals of sufficient magnitude to be detected by sound detectors located in the second object.

11. The system claimed in claim 10 wherein said laser is a $CO_2$ laser.

12. The system claimed in claim 10 wherein said laser is a CO laser.

13. The system claimed in claim 10 wherein said laser is a DBr laser.

14. The system claimed in claim 10 wherein said changing means comprises:

a. a power supply whose output is coupled to the input of said laser, so that when said power supply is turned on said laser will produce a pulse and when said power supply is turned off said laser will not have an output pulse; and b. a digital computer coupled to said directing means and said power supply, said computer will turn said power supply on and off in such a manner to produce laser output pulses that will vary in time and represent a coded message.

15. The system claimed in claim 10 wherein said changing means comprises:

a. a faraday rotator positioned in front of the output of said laser;

b. a first polarizer positioned between the output of said laser and said faraday rotator, said first polarizer polarizes the output of said laser;

c. a second polarizer positioned between the output of said faraday rotator and said directing means said second polarizer polarizes the output of said faraday rotator and directs said output to said directing means; and d. a digital computer coupled to said directing means and said faraday rotator, said computer will modulate the amplitude of the output of said laser by causing said faraday rotator to rotate the output of said laser to produce an output signal that contains information.

16. The system claimed in claim 15 further including an audio device whose output is coupled to the input of said computer, said audio device produces an audio output.

17. The system claimed in claim 10 wherein said directing means comprises:

a. a steerable mirror positioned in front of the output of said laser;

b. means for steering said mirror; the input of said steering means is coupled to the output of said changing means and the output of said steering means is coupled to said mirror; and c. a lens positioned behind said mirror, so that said lens may cause the output of said laser to be focused on a small spot of water at the air/water interface.

18. The system claimed in claim 17 wherein said steering means comprises drive electronics.

19. The system claimed in claim 10 wherein said directing means comprises:

a. a steerable mirror positioned in front of the output of said second polarizer;

b. means for steering said mirror, the input of said steering means is coupled to the output of said computer and the output of said steering means is coupled to said mirror; and c. a lens positioned behind said mirror so that the output of said laser is focused output on a small spot of water at the air/water interface.

20. The system claimed in claim 17 wherein said steering means comprises drive electronics.

21. A method for communicating between an object located above the surface of the water and an object located beneath the surface of the water including the steps of:

a. varying the time of production and duration of the pulses produced by a linear accelerator located aboard the object above the water's surface in order to produce a signal that contains information;

b. deflecting said pulses at a layer of water at the air/water interface; and c. heating said layer of water substantially immediately adjacent the air/water interface so that said layer of water will transform the signals produced by said pulses into acoustic signals which have sufficient magnitude to be detected by a sound detector located aboard the object beneath the water's surface.

* * * * *